US011992112B2

(12) United States Patent
Racicot et al.

(10) Patent No.: US 11,992,112 B2
(45) **Date of Patent: *May 28, 2024**

(54) BINOCULAR HARNESS SYSTEM

(71) Applicant: STONE GLACIER, INC., Bozeman, MT (US)

(72) Inventors: Kurt Michael Racicot, Bozeman, MT (US); Jeffrey Robert Sposito, Bozeman, MT (US)

(73) Assignee: Stone Glacier, Inc., Bozeman, MT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/967,325

(22) Filed: Oct. 17, 2022

(65) Prior Publication Data

US 2023/0032543 A1 Feb. 2, 2023

Related U.S. Application Data

(63) Continuation of application No. 17/239,633, filed on Apr. 25, 2021, now Pat. No. 11,470,949.
(Continued)

(51) Int. Cl.

| | |
|---|---|
| ***A45F 3/04*** | (2006.01) |
| ***A45C 11/08*** | (2006.01) |
| *A45F 3/14* | (2006.01) |

(52) U.S. Cl.
CPC ..... *A45F 3/04* (2013.01); *A45C 11/08* (2013.01); *A45F 2003/146* (2013.01); *A45F 2200/05* (2013.01)

(58) Field of Classification Search
CPC ..... A45C 11/08; A45C 13/005; A45C 13/30; A45C 13/34; A45C 15/00;
(Continued)

(56) References Cited

U.S. PATENT DOCUMENTS 3,782,614 A * 1/1974 Campisi ..... A45C 11/08 224/909
D271,540 S 11/1983 Williams
(Continued)

FOREIGN PATENT DOCUMENTS

AT 9558 U1 12/2007
DE 102011017410 A1 5/2014
WO WO-2019183256 A1 * 9/2019 ..... A45F 3/047

*Primary Examiner* — Peter N Helvey
*Assistant Examiner* — Matthew T Theis
(74) *Attorney, Agent, or Firm* — Reed Smith LLP; Walter M. Egbert, III; Richard J. Brown

(57) ABSTRACT

A binocular harness system having a pair of shoulder straps, a pair of upper torso straps, and a carrying pouch. The carrying pouch has a main body and a removable hood. The front side of the main body has a loop fastener panel that extends laterally across the front side. The hood has a front panel, a secondary panel that is configured to form a back and two sides of the hood, and an elongated pocket that extends along a rear edge and at least a portion of each side edge of the secondary panel, the elongated pocket contains a rod, and an elastomeric cord passes through a central bore in the rod, side portions of the elongated pocket, loops situated on either side of the back side of the main body, and conduits made of nylon webbing situated on or proximate to the bottom panel of the main body.

18 Claims, 10 Drawing Sheets

Related U.S. Application Data

(60) Provisional application No. 63/021,199, filed on May 7, 2020.

(58) Field of Classification Search
CPC ... A45C 2009/007; A45C 7/0086; A45C 9/00; A45F 2003/146; A45F 2200/05; A45F 2200/0533; A45F 3/04; A45F 3/047; A45F 3/14
USPC ..... 224/623, 637
See application file for complete search history.

(56) References Cited

U.S. PATENT DOCUMENTS

| | | | | |
|---|---|---|---|---|
| 5,016,797 | A | 5/1991 | Rowledge | |
| 5,172,838 | A * | 12/1992 | Rowell | A45C 11/38 224/664 |
| 6,095,328 | A | 8/2000 | Smithbaker, III et al. | |
| 6,926,184 | B2 | 8/2005 | Hancock et al. | |
| 7,036,943 | B1 | 5/2006 | Brewer | |
| 7,059,503 | B2 | 6/2006 | Andersen | |
| D601,341 | S | 10/2009 | Arman | |
| 8,720,681 | B1 | 5/2014 | Hancock et al. | |
| 9,210,978 | B1 | 12/2015 | Hunt | |
| 9,872,553 | B1 | 1/2018 | Erlandson | |
| D853,111 | S | 7/2019 | Lee et al. | |
| 11,284,691 | B2 | 3/2022 | Rosen et al. | |
| 11,470,949 | B2 * | 10/2022 | Racicot | A45F 3/047 |
| 2004/0140335 | A1 | 7/2004 | Hancock et al. | |
| 2006/0151563 | A1 | 7/2006 | Bussard | |
| 2008/0061099 | A1 * | 3/2008 | Tilby | A45C 11/00 224/675 |
| 2016/0327382 | A1 * | 11/2016 | Beck | A45C 7/0063 |
| 2021/0015228 | A1 | 1/2021 | Burns | |

* cited by examiner

BINOCULAR HARNESS SYSTEM

CROSS-REFERENCE TO RELATED APPLICATIONS

Pursuant to 35 U.S.C. § 119(e) this application is a continuation of U.S. Ser. No. 17/239,633, filed Apr. 25, 2021, which claims the benefit of U.S. Patent Application No. 63/021,199, filed on May 7, 2020.

BACKGROUND OF THE INVENTION

Field of the Invention

The present invention relates generally to the field of outdoor recreational gear, and more particularly, to an adjustable harness system for carrying binoculars in the field.

Description of the Related Art

U.S. Pat. No. 3,782,614 (Campisi, 1974) discloses binocular pocket that is adapted to be attached to an upper torso garment. The pocket comprises a body member and a flap member that is detachable attached to the body member. The flap member has an opening intermediate to the sides of the flap member to permit the binocular straps to pass through and rest around the neck of the wearer of the garment.

U.S. Pat. No. 6,095,328 (Smithbaker III et al., 2000) provides a carrying case for binoculars in which a tubular-shaped main body formed of a stretchable and resilient material is undersized in relation to the binoculars. The main body has openings on either end for exposing the binocular lenses and an aperture for exposing a focus adjustment mechanism during use. Each of the openings and aperture has a removable closure.

U.S. Pat. No. 6,926,184 (Hancock et al., 2005) discloses a harness system for holding an article such as binoculars. The system comprises a pair of shoulder straps, a pair of underarm straps, and a case disposed on the front of the wearer. The case has a cover with a substantially rigid lip hinged to the top edge that pivots into the space between the article and the body of the user. The cover incorporates a face sheet that interconnects the spaces apart sides of the cover to which the underarm straps are connected. The face sheet is curved to form a bottom edge that is situated beneath the binoculars and a top edge that extends above the upper end of the binoculars.

U.S. Pat. No. 9,872,553 (Erlandson, 2018) provides a support system and carrying case for binoculars. The system includes a neck strap and carrying case with a top opening. The carrying case is supported by a pair of elastomeric case support straps, each of which is coupled to an intermediate portion of the neck strap. A strap assembly is coupled to the lower portion of the case and attachable to a belt or garment of the user. The invention further comprises a case lid with a closure fastener that is releasable upon downward movement of the case.

U.S. Pat. No. D271,540 (Williams, 1983) depicts a binocular case design comprised of a relatively hard case with top and rear covers that are hingedly removable. This design does not incorporate a harness system.

U.S. Pat. No. D601,341 (Arman, 2009) illustrates a binocular case design comprised of three parts, the first of which fits around a center portion of the binoculars, and the second and third of which form separate covers for each end of the binoculars. The second and third parts of the cover are joined to each other and to the second part so that they can be pulled off the ends of the binoculars without falling off. This design does not incorporate a harness system.

U.S. Pat. No. D853,111 (Lee et al., 2019) shows a binocular case design featuring a purse-like compartment on the front of the wearer and an elongated, zippered pocket on the back side of the wearer. The purse-like compartment includes outer side pockets and horizontal rows of nylon webbing configured to facilitate the attachment of implements. This design incorporates a harness system.

BRIEF SUMMARY OF THE INVENTION

The present invention is a binocular harness system comprising: a pair of shoulder straps; a pair of upper torso straps; and a carrying pouch; wherein the carrying pouch comprises a main body and a removable hood; wherein the main body comprises a front side, a back side, two side walls that join the front side to the back side, and a bottom panel; wherein the front side of the main body comprises a panel of loop fastener that extends laterally across a width of the front side wherein the hood comprises a front panel, a secondary panel that is configured to form a back and two sides of the hood, and an elongated pocket that extends along a rear edge and at least a portion of each side edge of the secondary panel; wherein the elongated pocket contains a rod; and wherein an elastomeric cord passes through a central bore in the rod, through side portions of the elongated pocket, through loops situated on either side of the back side of the main body, and through conduits made of nylon webbing situated on or proximate to the bottom panel of the main body. In a preferred embodiment, the main body further comprises a floor with foam padding configured to protect an article contained within the main body. Preferably, the foam padding is removably attached to the floor with hook-and-loop fastener.

In a preferred embodiment, the present invention further comprises a fastener loop made of nylon webbing situated directly underneath the loop fastener panel on a right side of the front side of the main body and a fastener loop made of nylon webbing situated directly underneath the loop fastener panel on a left side of the front side of the main body. Preferably, the bottom panel of the main body comprises a loop fastener made of nylon webbing situated on a right side of the bottom panel and a fastener loop made of nylon webbing situated on a left side of the bottom panel. The present invention preferably further comprises a pull tab that is attached to an outside center of the elongated pocket. The present invention preferably further comprises a side pocket on an outside of each of the two side walls and an elastomeric member that extends across a top of each side pocket.

In a preferred embodiment, each upper torso strap is attached to one side of the back side of the main body with a buckle, one part of which passes through the loop on a right or left side of the back side of the main body. Preferably, the shoulder straps are joined to the upper torso straps by a back member. The shoulder straps are preferably adjustable in length via ratchet buckles located on distal ends of the shoulder straps.

In a preferred embodiment, the distal ends of the shoulder straps are attached to a top edge of a back plate, and a back face of the back plate is covered with a panel of loop fastener material. Preferably, the elastomeric cord makes a full loop that terminates at a cord fastener that joins two ends of the elastomeric cord together and is situated between the conduits. The present invention preferably comprises a foam pad that is situated between the back side of the main body and a mesh pocket. The present invention preferably comprises a foam pad on an inside of the front side of the main body.

In a preferred embodiment, and inside surface of the back side of the main body is covered with a hook fastener material. In another preferred embodiment, a strip of hook fastener material extends across an inside front end of the hood.

REFERENCE NUMBERS

Figure 2:
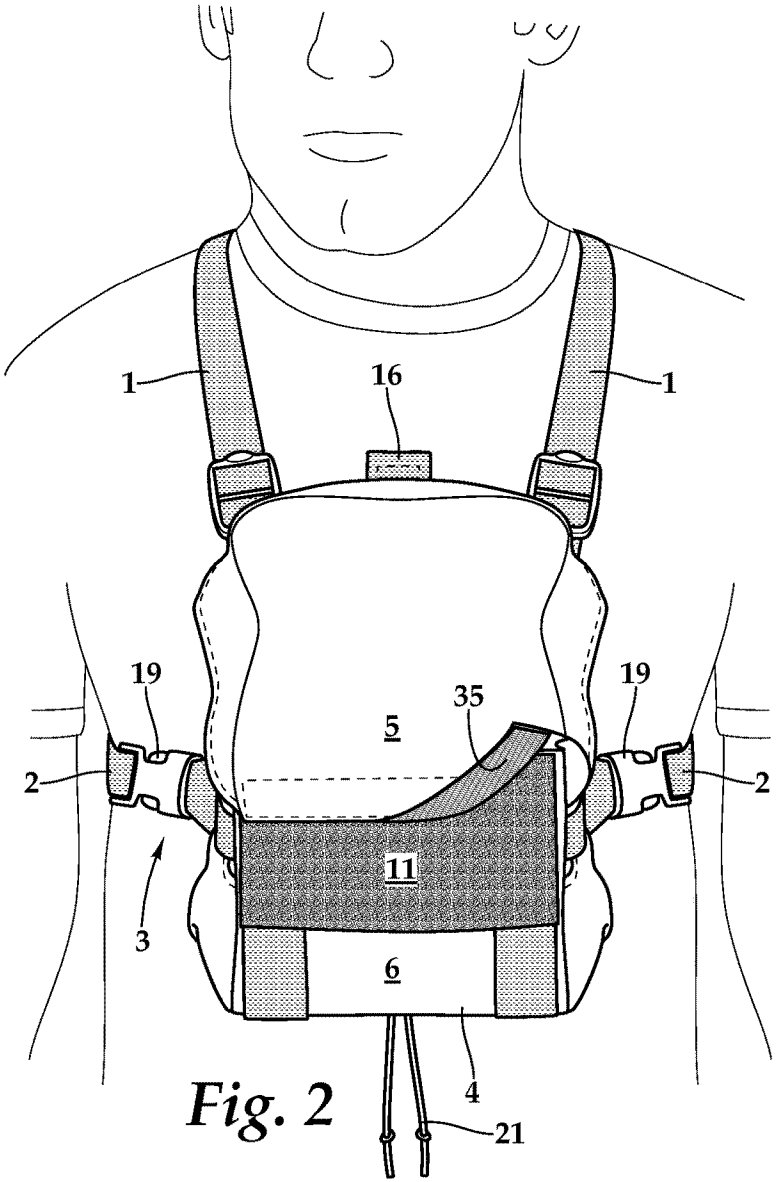
FIG. 2 is a front view of the invention shown worn by a person with the hood and back late in a highest position.

1 Shoulder strap
2 Upper torso strap
3 Carrying pouch
4 Main body (of carrying pouch)
5 Removable hood
6 Front side (of main body)
7 Back side (of main body)
8 Side wall (of main body)
9 Floor (of main body)
10 Foam padding
11 Loop fastener panel
12 Fastener loop
13 Front panel
14 Secondary panel
15 Elongated pocket
16 Pull tab
17 Side pocket
18 Elastomeric member
19 Buckle
20 Loop
21 Elastomeric cord
22 Rod
23 Side portion (of elongated pocket)
24 Conduit
25 Mesh pocket
26 Back plate
27 Back member
28 Ratchet buckle
29 Back plate extension
30 Front face (of back plate)
31 Back face (of back plate)
32 Loop fastener material
33 Cord fastener
34 Hook fastener material
35 Strip of hook fastener material

DETAILED DESCRIPTION OF INVENTION

Figure 1:
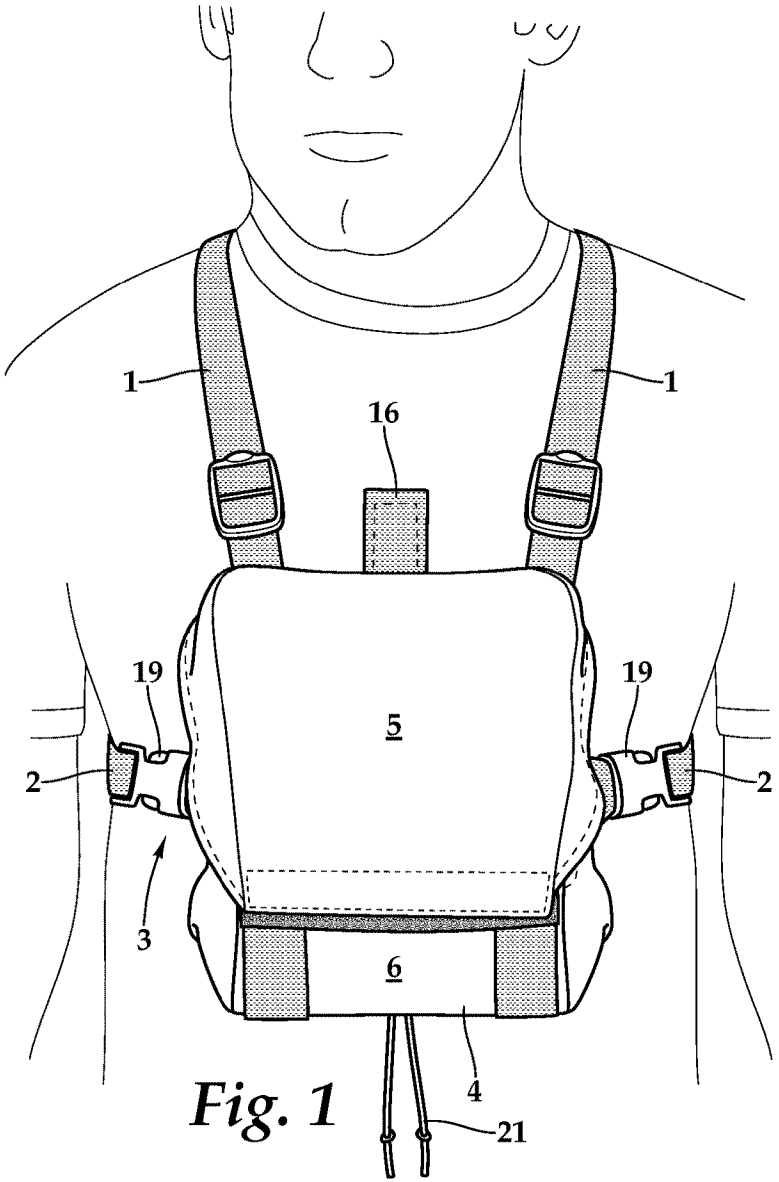
FIG. 1 is a front view of the invention shown worn by a person with the hood and back plate in a lowest position.
Figure 13:
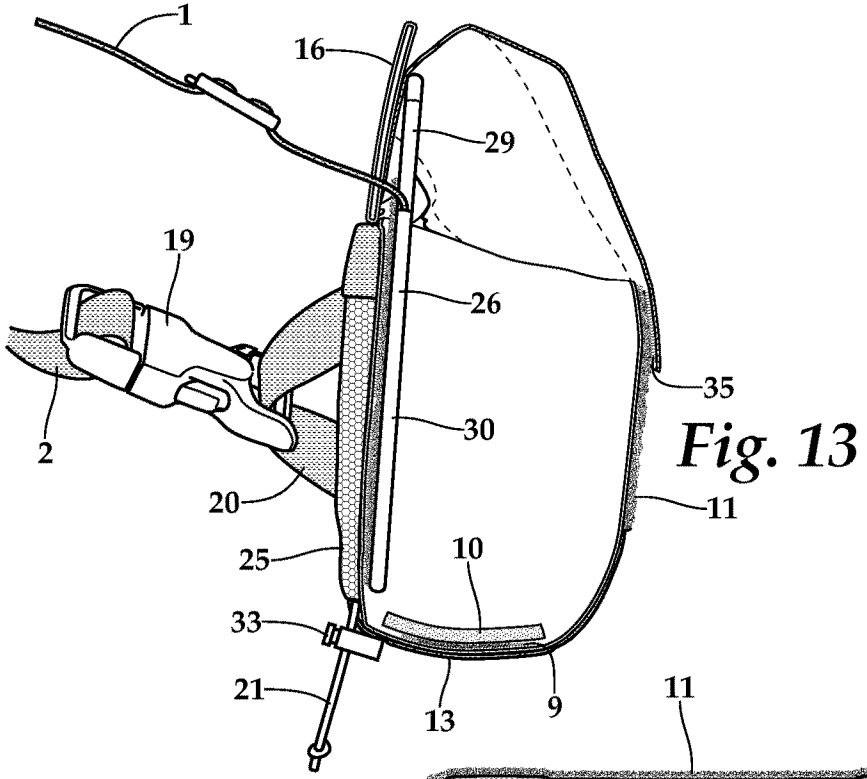
FIG. 13 is a side section view of the present invention showing the floor and foam padding on the inside of the main body.

FIG. 1 is a front view of the invention shown worn by a person with the hood and back plate in a lowest position. As shown in this figure, the present invention comprises a pair of shoulder straps 1, a pair of upper torso straps 2, and a carrying pouch 3. The carrying pouch 3 comprises a main body 4 and a removable hood 5. The main body 4 comprises a front side 6, a back side 7, and two side walls 8 that join the front side to the back side. The main body 4 further comprises a floor 9 with foam padding 10 to protect the article contained within the main body. The foam padding 10 may be removable attached to the floor 9 with hook-and-loop fastener (see FIG. 13).

Figure 14:
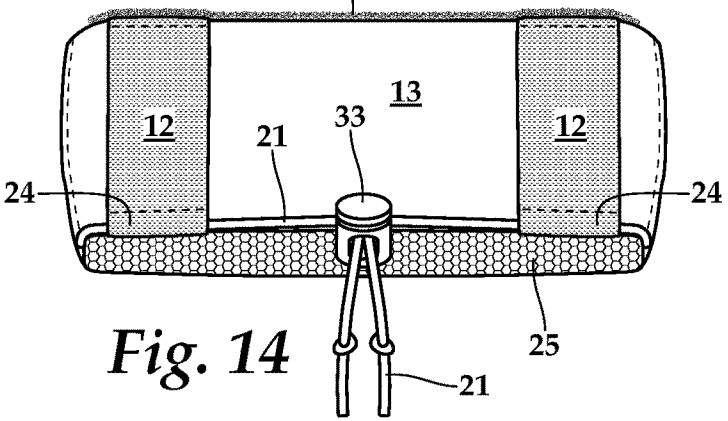
FIG. 14 is a bottom view of the present invention.
Figure 12:
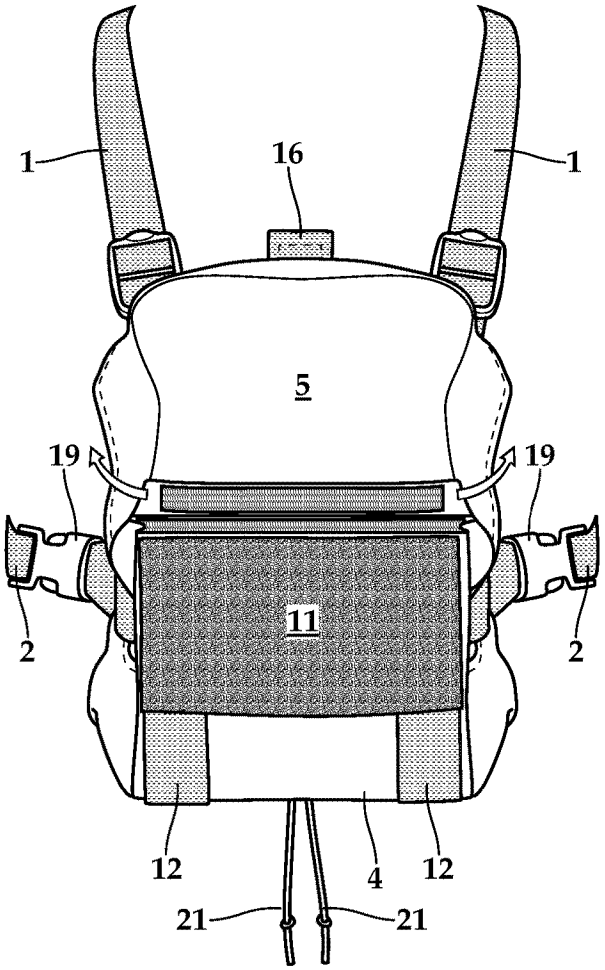
FIG. 12 is a front view of the present invention shown with the hood pulled back and the front side of the main body fully exposed.

FIG. 2 is a front view of the invention shown worn by a person with the hood and back plate in a highest position. As shown in this figure, the front side 6 of the main body comprises a panel of loop fastener 11 that extends laterally across the full width of the front side 6 and downwardly over at least half of the height of the front side 6 (see FIG. 12). Situated directly underneath the loop fastener panel 11 on the far right and left sides of the front side 6 are fastener loops 12 made of nylon webbing. Similar fastener loops 12 are located on either side of the bottom panel 13 of the carrying pouch 3 (see FIG. 14). The fastener loops 12 facilitate the attachment of various tools and implements.

Figure 3:
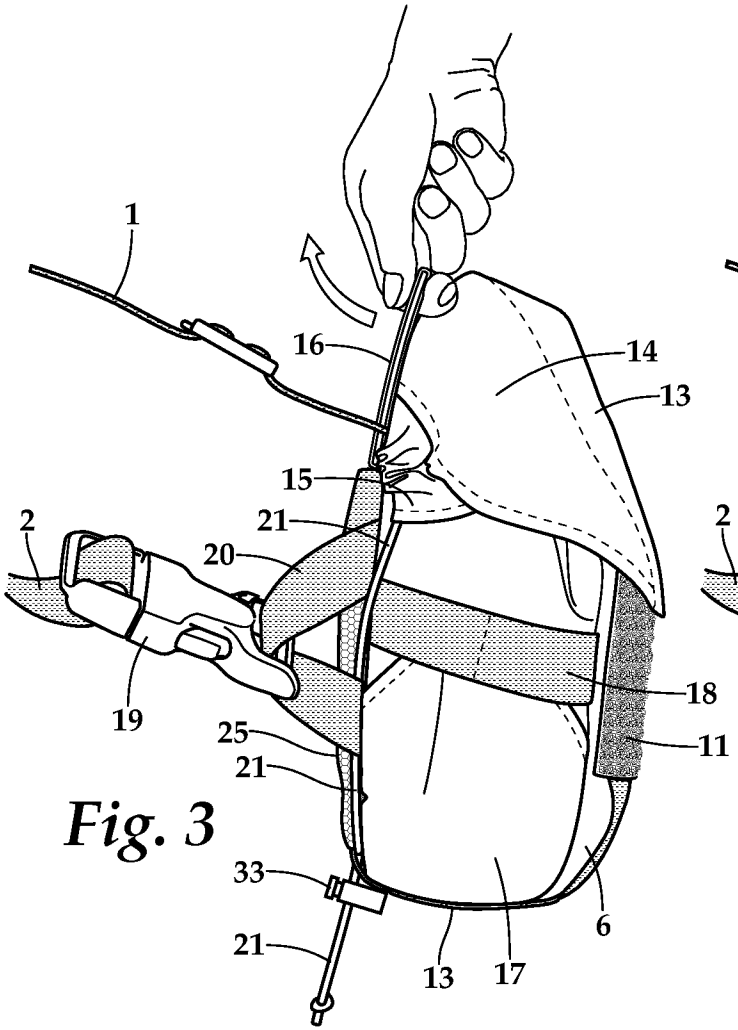
FIG. 3 is a side view of the invention shown with the hood in a closed position prior to opening.

FIG. 3 is a side view of the invention shown with the hood in a closed position prior to opening. As shown in this figure, the hood 5 comprises a front panel 13, a secondary panel 14 that forms the back and sides of the hood 5, and an elongated pocket 15 that extends along the entire rear edge and at least a portion of each of the side edges of the secondary panel 14. (Note that the front panel 13 and the secondary panel 14 may be formed from the same piece of material or separate pieces of material. They may also each be formed from more than one piece of material.) A pull tab 16 that is preferably comprised of nylon webbing with an internal rigid (plastic) plate for ease of grasp is attached to the outside of the center of the elongated pocket 15. Side pockets 17 are provided on the outside of each of the side walls 8, and an elastomeric member 18 extends across the top of each side pocket 17 to prevent items within the side pocket from falling out.

Each upper torso strap 2 is attached to one side (right and left) of the back side 7 of the main body 4 with a buckle 19, one part of which passes through a loop 20 formed of nylon webbing. The upper torso straps 2 can be decoupled from the loops 20 by unfastening the buckles 19. As shown more fully in FIG. 7, an elastomeric cord 21 passes through a rod 22 in the elongated pocket 15, through the side portions 23 of the elongated pocket 15, through the loops 20 and then through a conduit 24 formed with the same nylon webbing that forms the fastener loops 12 on the bottom panel 13 of the carrying pouch 3 (see FIG. 14). The conduits 24 are situated between the fastener loops 12 on the bottom panel 13 and the mesh pocket 25 that covers the entire outer surface of the back side 7 of the main body 4 (see FIG. 7).

Figure 4:
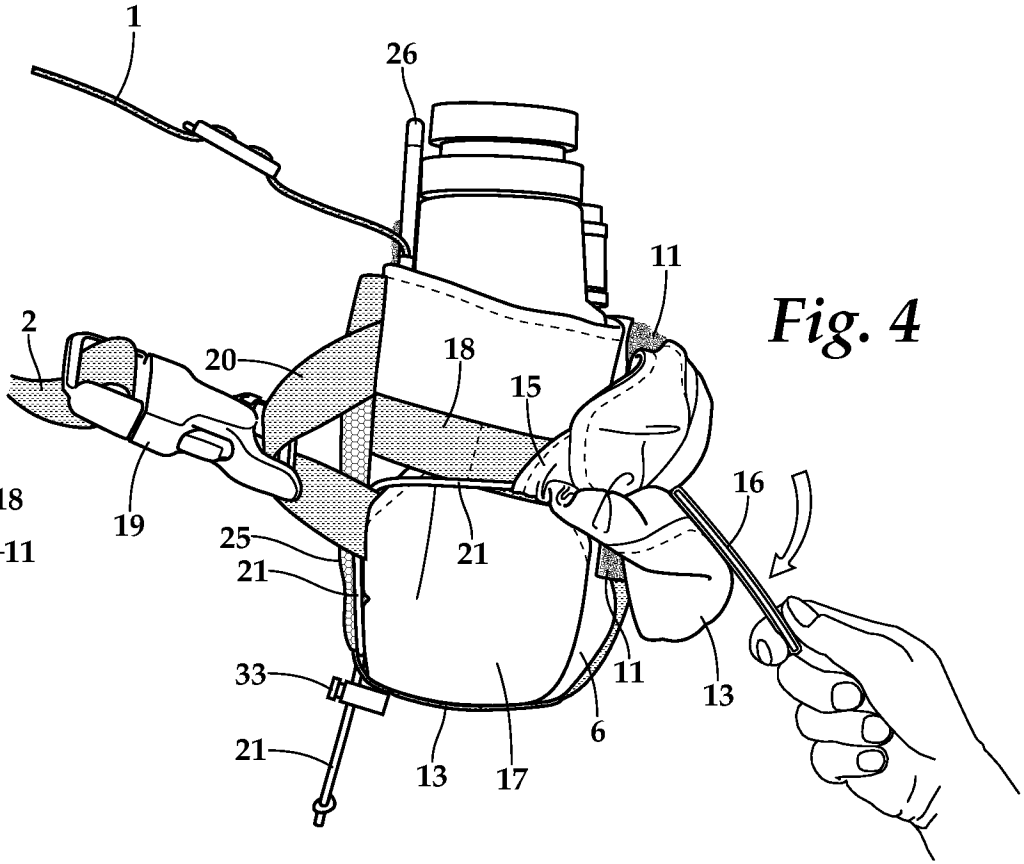
FIG. 4 is a side view of the invention shown with the hood in an open position.
Figure 15:
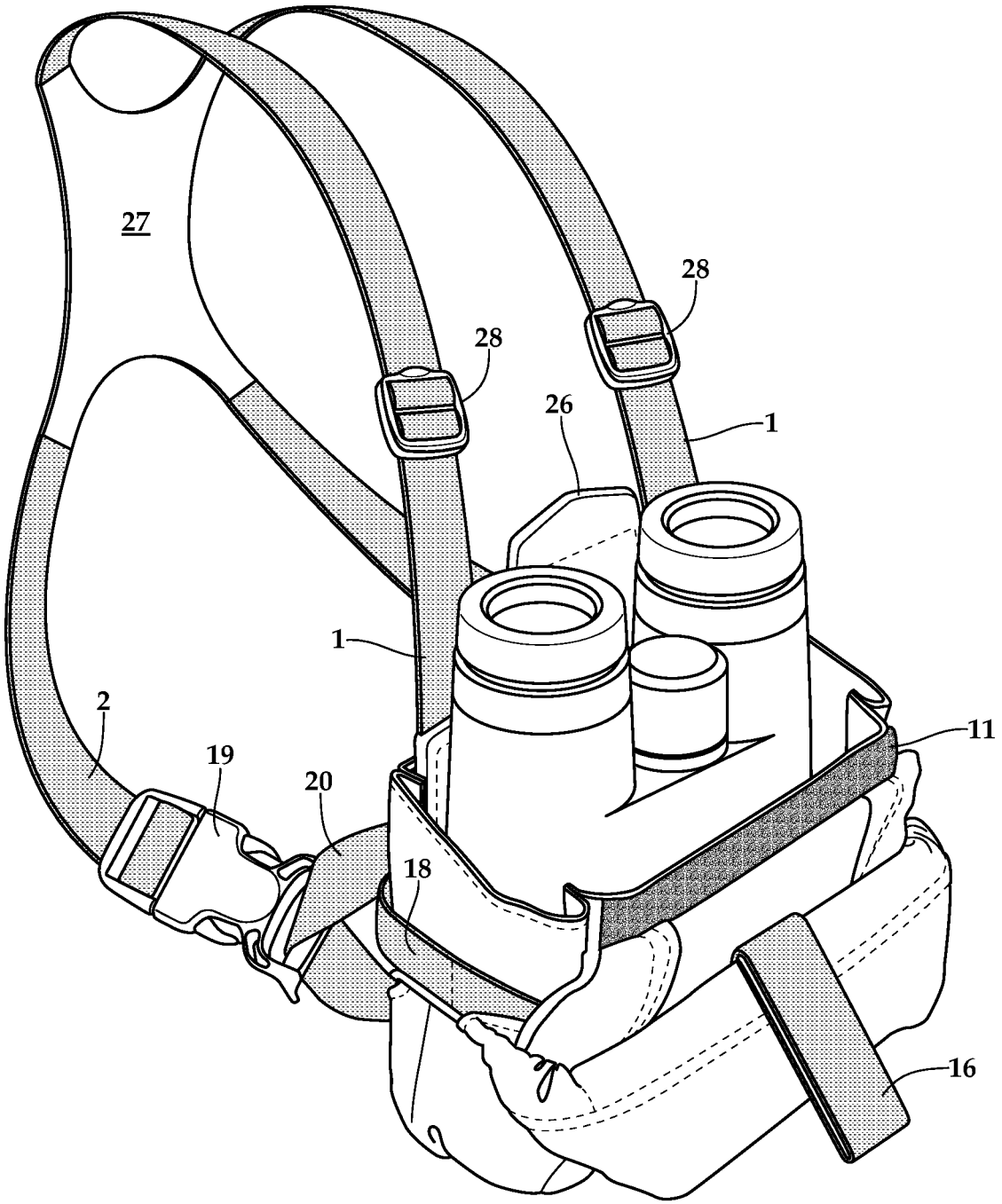
FIG. 15 is a perspective view of the present invention shown fully assembled with the hood pulled forward and the binoculars exposed.

FIG. 4 is a side view of the invention shown with the hood in an open position. As shown in this figure, when the pull tab 15 is pulled upward and forward (over the back plate 26), the elastomeric cord 21 stretched, and the rod 22 is pulled over the binoculars situated within the carrying pouch 3. The present invention is specifically designed to allow the binoculars to be accessed quickly and quietly in those situations (such as hunting) in which stealth is important. For this reason, the present invention does not require the use of magnets, snaps, buckles or other types of fasteners that make noise in order to access the binoculars (buckles are used only to adjust the harness system on the wearer prior to heading into the field). A person need simply pull on the pull tab 5, lift the hood 5, and remove the binoculars from the carrying pouch 3 (see FIG. 15).

Figure 5:
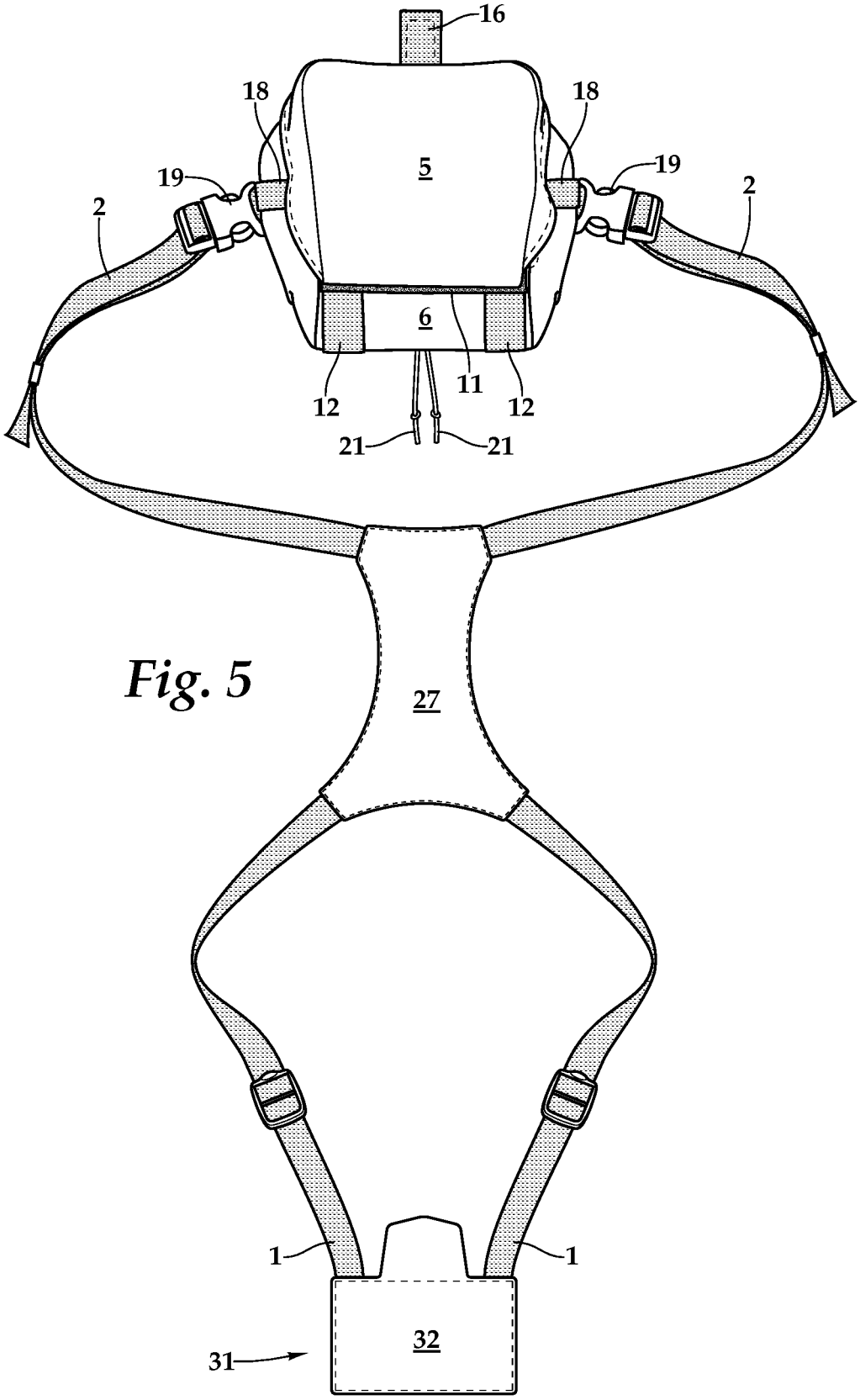
FIG. 5 is a front disassembled view of the invention shown with the back place removed from the carrying pouch.

FIG. 5 is a front disassembled view of the invention shown with the back plate removed from the carrying pouch. As shown in this figure, the upper torso straps 2 are adjustable in length via the buckles 19. The shoulder straps 1 are joined to the upper torso straps 2 by a back member 27, preferably made of the same material of which the hood 5 and carrying pouch 3 are made. In a preferred embodiment, this material is waterproof, windproof and breathable material such as HYDRASHIELD™ canvas made by Kodiak Canvas of Layton, Utah. The present invention is designed to be worn underneath a backpack in which case the back member 27 would lie between the backpack and the wearer.

The length of the shoulder straps 1 is also adjustable via ratchet buckles 28 located on the distal ends (that is, the end farthest form the back member 27) of the shoulder straps 1. The distal ends of the shoulder straps 1 are attached to the top edge of the back plate 26 on either side of the back plate extension 29. The back plate 26 and back plate extension 29 are comprised of a relative rigid material (such as plastic) and overlaid with the same canvas material as the hood 5 and carrying case 3. The back plate extension 29 protrudes upwardly from the center of the top edge of the back plate 26. As shown in this figure, the front face 30 of the back plate 26 is comprised of canvas material, whereas the entire back face 31 of the back plate 26 is covered with a panel of loop fastener material 32 (see FIG. 6).

Figure 6:
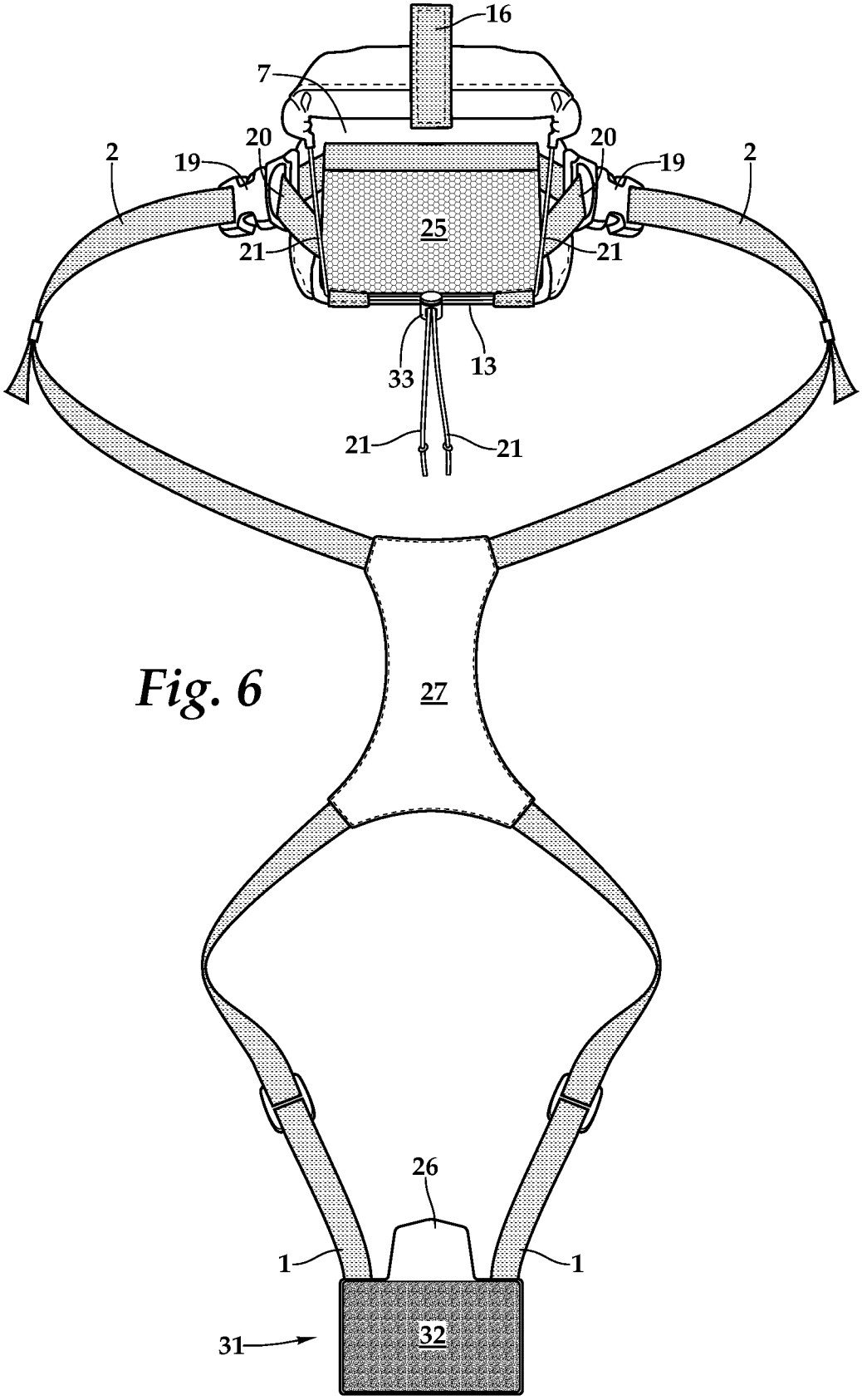
FIG. 6 is a rear disassembled view of the invention shown with the back plate removed from the carrying pouch.

FIG. 6 is a rear disassembled view of the invention shown with the back plate removed from the carrying pouch. As shown in this figure, the elastomeric cord 21 makes a full loop that terminates at a cord fastener 33 that joins the two ends of the elastomeric cord 21 together and is situated in between the conduits 24 on the bottom panel 13, directly underneath the mesh pocket 25. The tension on the elastomeric cord 21 may be adjusted via the cord fastener 33 in order to accommodate smaller or larger sizes of binoculars. When the hood 5 is in a closed position over the binoculars, the elastomeric cord 21 maintains downward pressure on the hood 5, thereby keeping the binoculars secure and preventing them from shifting inside of the carrying pouch 3.

Figure 7:
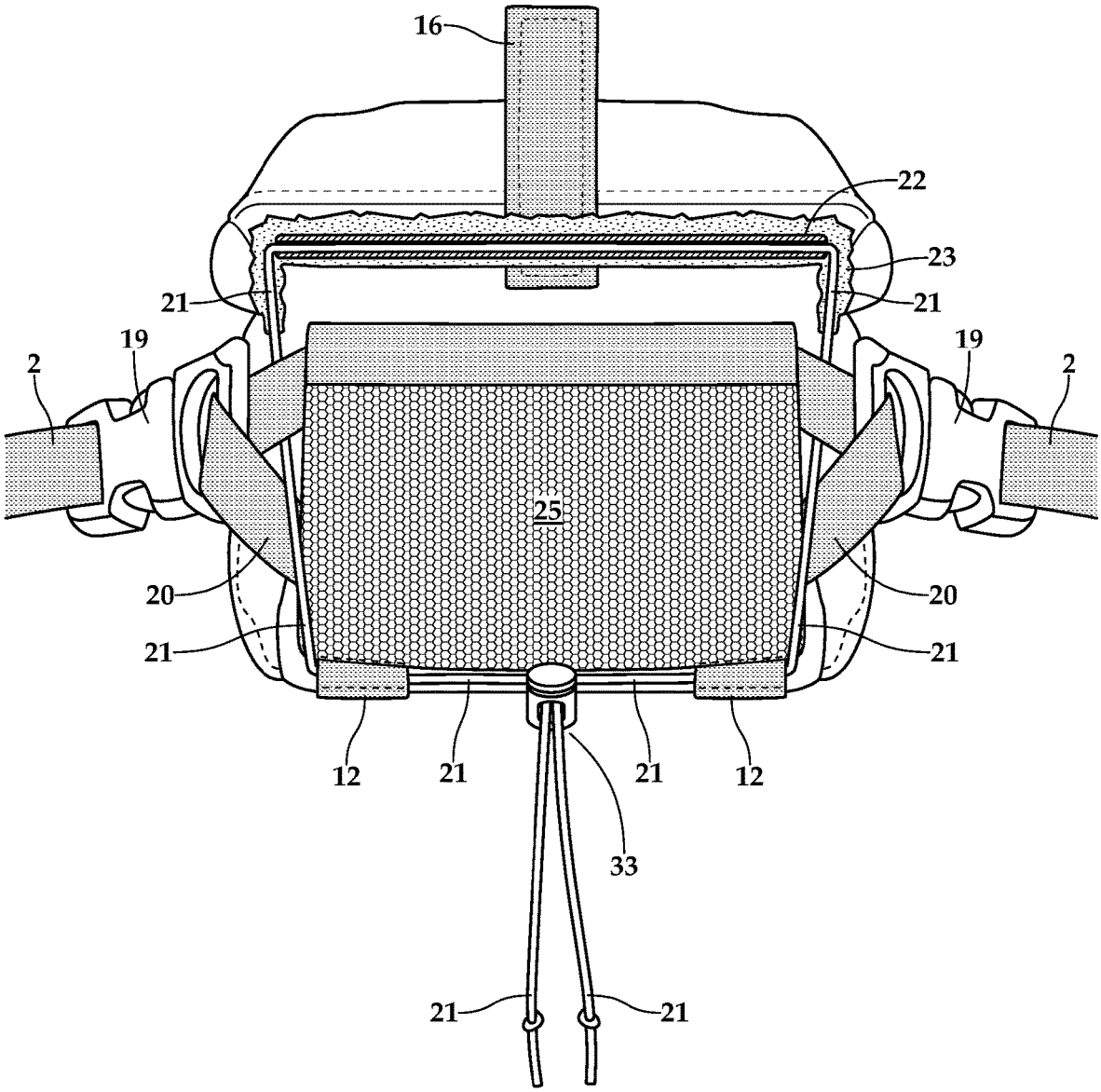
FIG. 7 is a rear view of the invention shown with a cutaway view of the rear bottom edge of the hood.

FIG. 7 is a rear view of the invention shown with a cutaway view of the rear bottom edge of the hood. As shown in this figure, a rod 22 is situated within that portion of the elongated pocket 15 that extends across the rear edge of the hood 5. The elongated rod 22 comprises a central bore through which the elastomeric cord 21 passes. This figure clearly shows the loop made by the elastomeric cord 21, which supplies the tension that holds the hood 5 over the top of the binoculars. Although not shown a foam pad preferably lies between the mesh pocket 25 and the back side 7 of the main body 4. This foam pad preferably covers the entire back surface of the back side 7 of the main body 4 in order to provide cushioning for the binoculars. A similar foam pad (not shown) is also situated on the inside of the front side 6 of the main body 4. Please note that the shoulder straps have been omitted form this figure for clarity.

Figure 8:
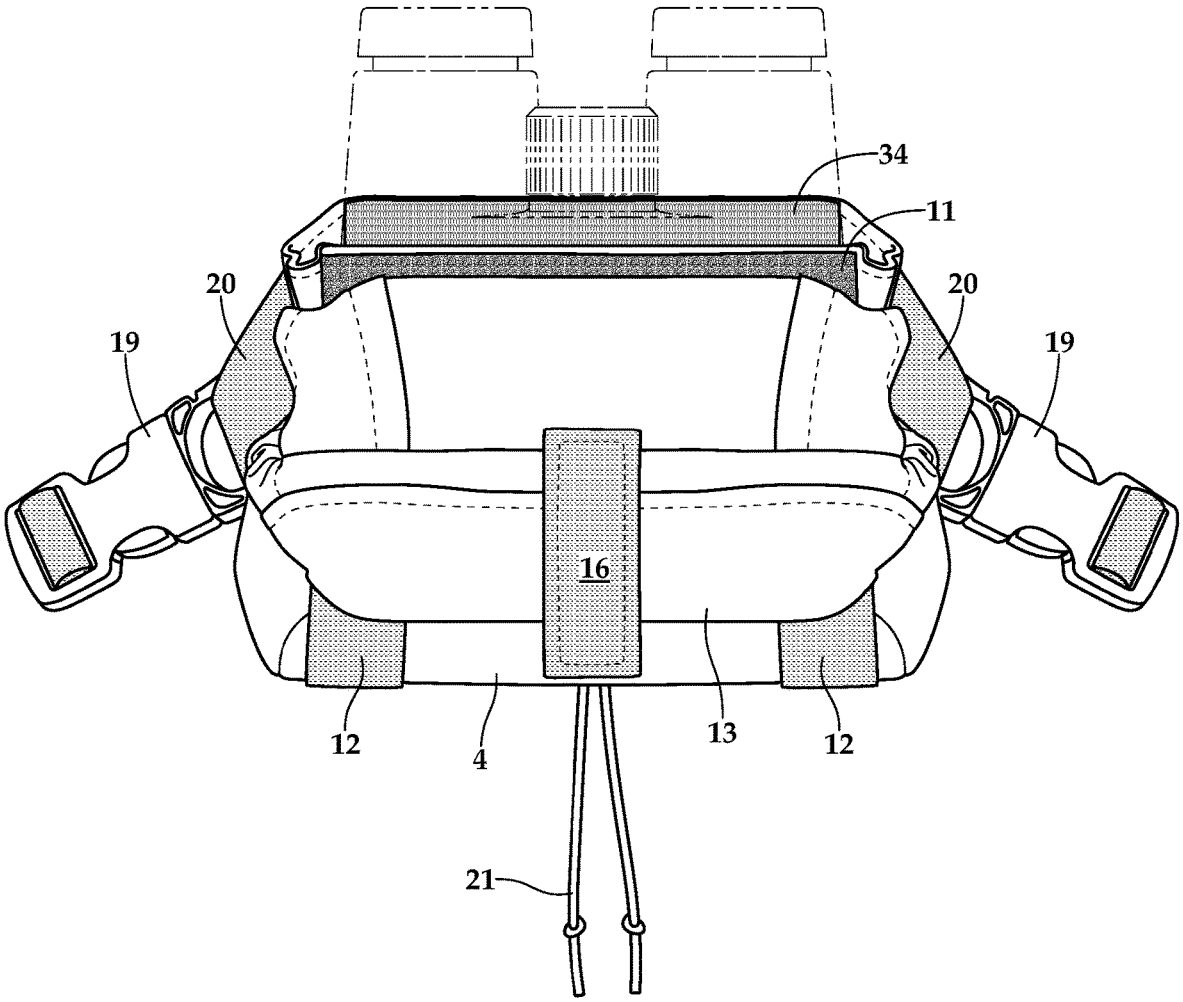
FIG. 8 is a front view of the invention shown with the hood in an open position prior to insertion of the back plate.

FIG. 8 is a front view of the invention shown with the hood in an open position prior to insertion of the back plate. As shown in this figure and in FIG. 9, the entire inside surface of the back side 7 of the main body 4 is covered with a hook fastener material 34. This allows the back plate 26 to be positioned on the inside of the back side 7 of the main body 4 and the height of the back plate 26 relative to the back side 7 to be adjusted through the placement of the loop fastener material 32 on the hook fastener material 34. The purpose of the adjustability of the height of the back plate 26 is to allow the carrying pouch 3 to accommodate smaller or larger sizes of binoculars.

In a similar manner, the position of the hood 5 relative to the front side 6 of the main body 4 may also be adjusted. A strip of hook fastener material 35 extends across the inside front end of the hood 5. This strip of hook fastener material 35 can be positioned on the loop fastener panel 11, as needed, to accommodate smaller or larger sizes of binoculars. Once the back plate 26 and hood 5 have been adjusted for the size of the binoculars, the tension on the elastomeric cord 21 can be adjusted via the cord fastener 33 to provide an appropriate amount of tension. Lastly, the length of the shoulder and upper torso straps 1, 2 can be adjusted to fir the wearer.

Figure 9:
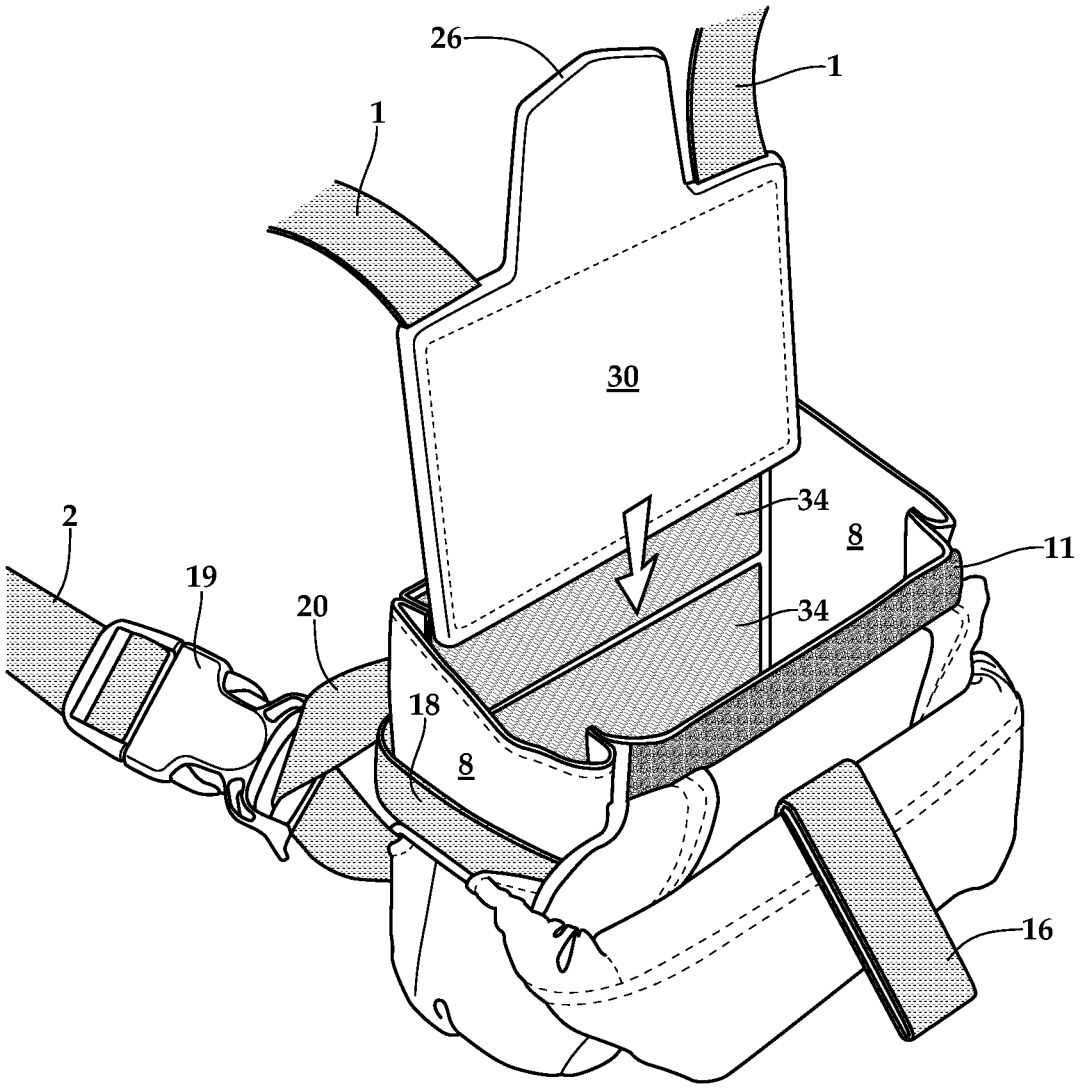
FIG. 9 is a front perspective view of the present invention illustrating the insertion and adjustment of the back plate inside the carrying pouch.

FIG. 9 is a front perspective view of the present invention illustrating the insertion and adjustment of the back plate inside the carrying pouch. As shown in this figure, the internal compartment of the carrying pouch 3 is exposed without the need to un-do any hook-and-loop fasteners (which make noise) or un clip any buckles. The hook-and-loop fasteners are used only to adjust the size of the invention to fit a particular pair of binoculars before going out into the field.

Figure 10:
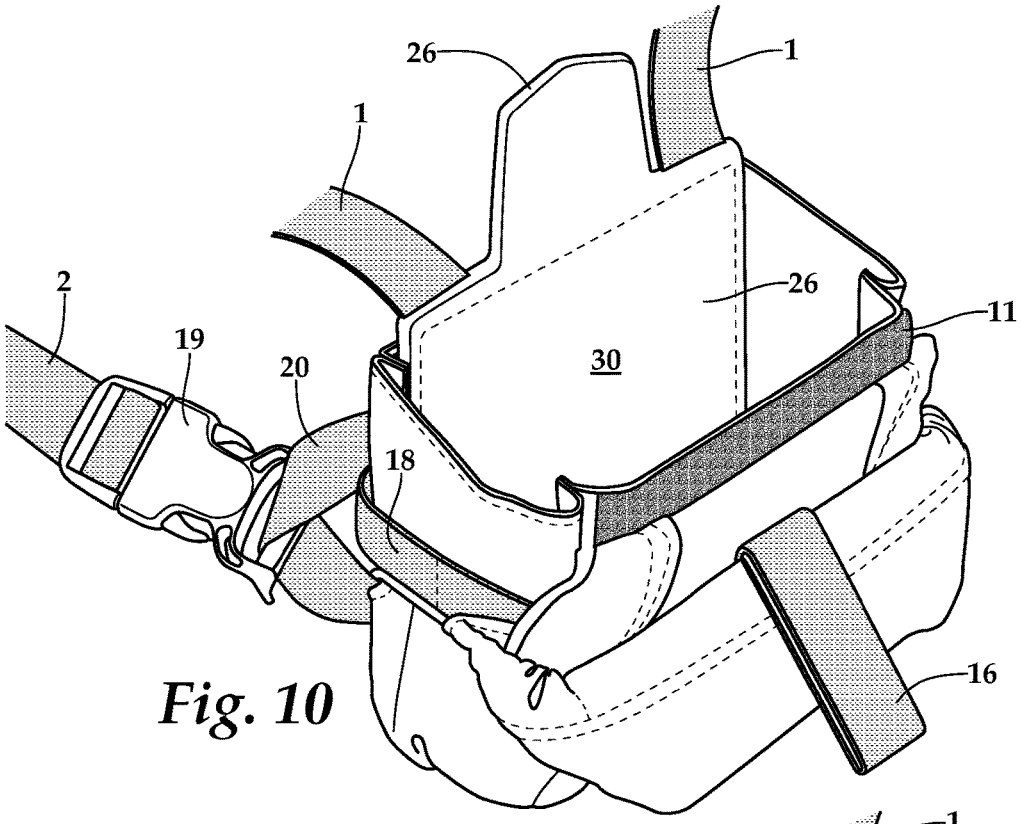
FIG. 10 is a front perspective view of the present invention shown with the hood in an open position.
Figure 11:
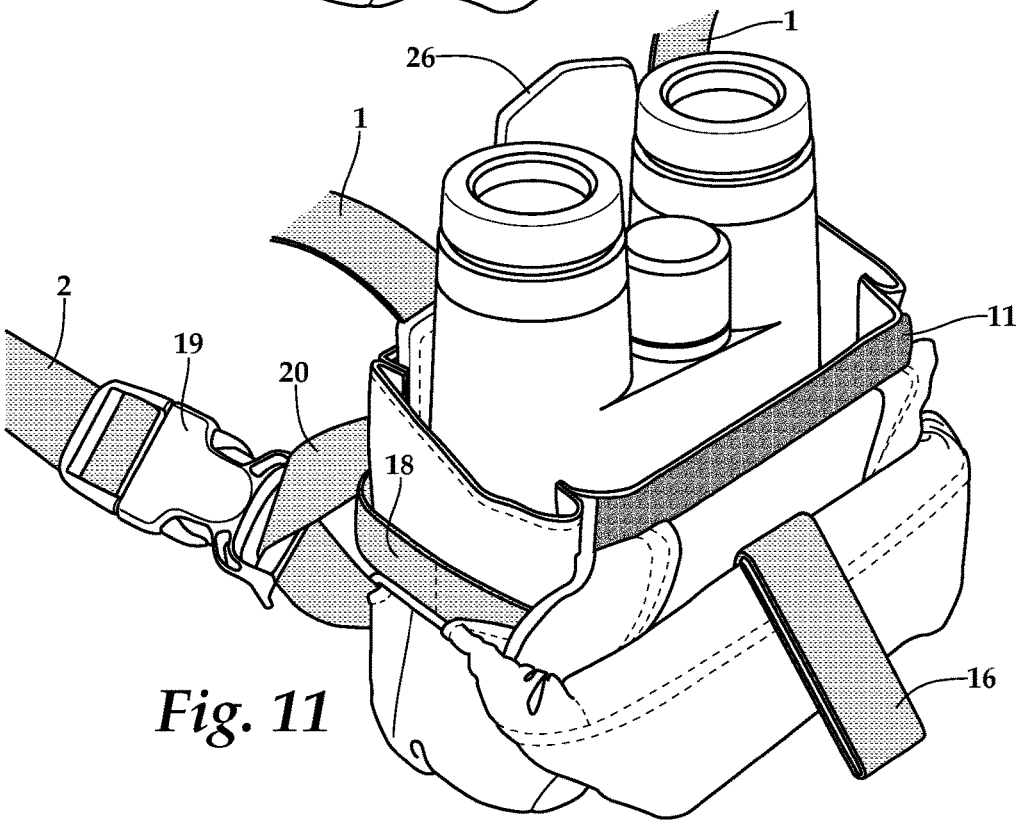
FIG. 11 is a front perspective view of the present invention shown with the hood in an open position and a pair of binoculars situated in the carrying pouch.

FIG. 10 is a front perspective view of the present invention shown with the hood in an open position, and FIG. 11 is a front perspective view of the present invention shown with the hood in an open position and a pair of binoculars situated in the carrying pouch. In these two figures, the back plate 26 is at its lowest position within the carrying pouch 3. Ideally, the back plate 26 is situated so that the top of the back plate 26 is approximately 0.75 inches below eye cup height.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A binocular harness system comprising:
a pair of straps;
a carrying pouch comprising
a main body comprising a front side, a back side, two side walls, and a bottom panel; and
a hood comprising a front panel, a back and two sides, and an elongated pocket that extends along a rear edge; the elongated pocket containing a rod; and
an elastomeric cord passing through a central bore in the rod, through loops situated on either side of the back side of the main body and situated on or proximate to the bottom panel of the main body.

2. The binocular harness system of claim 1, wherein the pair of straps comprises a pair of upper torso straps, each torso strap attached to one side of the back side of the main body with a buckle, one part of which passes through the loop on a right or left side of the back side of the main body.

3. The binocular harness system of claim 2, wherein the pair of straps further comprises a pair of shoulder straps joined to the upper torso straps by a back member.

4. The binocular harness system of claim 3, wherein the shoulder straps are adjustable in length via ratchet buckles located on distal ends of the shoulder straps.

5. The binocular harness system of claim 3, wherein the distal ends of the shoulder straps are attached to a top edge of a back plate; and wherein a back face of the back plate is covered with a panel of hook-and-loop fastener.

6. The binocular harness system of claim 5, wherein an inside surface of the back side of the main body is covered with a hook-and-loop fastener.

7. The binocular harness system of claim 1, wherein the main body further comprises a floor with foam padding configured to protect an article contained within the main body.

8. The binocular harness system of claim 7, wherein the foam padding is removably attached to the floor with hook-and-loop fastener.

9. A binocular harness system comprising:
a pair of straps;
a carrying pouch comprising
a main body comprising a front side, a back side, two side walls, and a bottom panel; and
a hood comprising a front panel removably secured to the front side of the main body, a back and two sides, and an elongated pocket that extends along a rear edge; the elongated pocket containing a rod; and
an elastomeric cord passing through a central bore in the rod, through loops situated on either side of the back side of the main body and situated on or proximate to the bottom panel of the main body.

10. The binocular harness system of claim 9, wherein the front side of the main body comprises a panel of hook-and-loop fastener that extends across a portion of the front side.

11. The binocular harness system of claim 10, wherein a strip of hook-and-loop fastener extends across an inside front end of the hood.

12. The binocular harness system of claim 9, wherein the loops situated on or proximate to the bottom panel of the main body comprise conduits made of nylon webbing.

13. The binocular harness system of claim 9, wherein the elongated pocket extends along a portion of an edge of each side panel, and wherein the elastomeric cord passes through the elongated pocket extending along a portion of an edge of each side panel.

14. The binocular harness system of claim 9, wherein the pair of straps comprising shoulder straps and the distal ends of the shoulder straps are attached to a top edge of a back plate; and wherein a back face of the back plate is covered with a panel of hook-and-loop fastener, wherein an inside surface of the back side of the main body is covered with a hook-and-loop fastener.

15. A binocular harness system comprising:
a pair of straps;
a carrying pouch comprising
a main body comprising a front side having a panel of hook-and-loop fastener thereon, the panel extending along at least half the height of the front side, a back side, two side walls, and a bottom panel; and
a hood comprising a front panel, a back portion and two sides, the hood having a strip of hook-and-loop fastener extending across an inside front end of the front panel for removable attachment to the front side of the main body; wherein the hood comprises an elongated pocket that extends along a rear edge of the back portion, the elongated pocket containing a rod; and
the binocular harness system comprises an elastomeric cord passing through a central bore in the rod and through loops situated on either side of the back side of the main body and situated on or proximate to the bottom panel of the main body.

16. The binocular harness system of claim 15, wherein each strap of the pair of straps is joined at a back plate having a hook-and-loop fastener, a back face of the back plate comprises hook-and-loop material; and an inside surface of the back side of the main body is covered with a hook-and-loop fastener material.

17. The binocular harness system of claim 15, wherein the elastomeric cord makes a full loop that terminates at a cord fastener that joins two ends of the elastomeric cord together and is situated between the loops situated on or proximate to the bottom panel of the main body.

18. The binocular harness system of claim 15, wherein the elongated pocket extends along a portion of an edge of each side panel, and wherein the elastomeric cord passes through the elongated pocket extending along a portion of an edge of each side panel.

* * * * *